US009111674B2

(12) United States Patent
Hashimoto et al.

(10) Patent No.: US 9,111,674 B2
(45) Date of Patent: Aug. 18, 2015

(54) R-T-B BASED PERMANENT MAGNET

(71) Applicant: TDK CORPORATION, Tokyo (JP)

(72) Inventors: Ryuji Hashimoto, Tokyo (JP); Kenichi Suzuki, Tokyo (JP); Kyung-Ku Choi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/257,206

(22) Filed: Apr. 21, 2014

(65) Prior Publication Data

US 2014/0320243 A1 Oct. 30, 2014

(30) Foreign Application Priority Data

Apr. 25, 2013 (JP) ..... 2013-092237

(51) Int. Cl.
*H01F 1/057* (2006.01)
*H01F 10/12* (2006.01)

(52) U.S. Cl.
CPC ..... *H01F 1/057* (2013.01); *H01F 10/126* (2013.01)

(58) Field of Classification Search
CPC ..... H01F 1/057; H01F 10/126
USPC ..... 148/101
IPC ..... H01F 1/0577, 41/026
See application file for complete search history.

(56) References Cited

U.S. PATENT DOCUMENTS

| | | | | |
|---|---|---|---|---|
| 4,770,723 | A | 9/1988 | Sagawa et al. | |
| 5,089,065 | A | 2/1992 | Hamano et al. | |
| 2003/0079805 | A1 | 5/2003 | Hamada et al. | |
| 2008/0050581 | A1 * | 2/2008 | Miwa et al. | 428/332 |
| 2008/0054738 | A1 | 3/2008 | Komuro et al. | |
| 2008/0241368 | A1 | 10/2008 | Komuro et al. | |
| 2008/0241513 | A1 | 10/2008 | Komuro et al. | |
| 2013/0093551 | A1 | 4/2013 | Peng et al. | |
| 2013/0135069 | A1 | 5/2013 | Miyamoto et al. | |
| 2014/0320244 | A1 | 10/2014 | Hashimoto et al. | |
| 2014/0320245 | A1 | 10/2014 | Hashimoto et al. | |
| 2014/0320246 | A1 | 10/2014 | Hashimoto et al. | |

FOREIGN PATENT DOCUMENTS

| | | | |
|---|---|---|---|
| JP | A-59-046008 | | 3/1984 |
| JP | H-06-942 | B2 | 1/1994 |
| JP | H-06-2930 | B2 | 1/1994 |
| JP | H-06-6776 | B2 | 1/1994 |
| JP | H-06-112026 | A | 4/1994 |
| JP | 2005-286152 | A | 10/2005 |
| JP | A-2008-060183 | | 3/2008 |
| JP | 2008-263208 | A | 10/2008 |
| JP | A-2008-266767 | | 11/2008 |
| JP | A-2008-270699 | | 11/2008 |
| JP | A-2011-187624 | | 9/2011 |
| JP | A-2012-039100 | | 2/2012 |
| JP | A-2012-043968 | | 3/2012 |
| JP | 53-70609 | B1 | 12/2013 |
| WO | 2012003702 | A1 | 1/2012 |

OTHER PUBLICATIONS

May 20, 2014 Decision for Granting a Patent in Japanese Patent Application No. JP2013-092235.
Nov. 14, 2014 Office Action issued in U.S. Appl. No. 14/257,541.
Dec. 10, 2014 Office Action issued in U.S. Appl. No. 14/262,156.
Dec. 15, 2014 Office Action issued in U.S. Appl. No. 14/261,516.
Uehara, Minoru. "Microstructure and Permanent Magnet Properties of a Perpendicular Anisotropic NdFeB/Ta Multilayered Thin Film Prepared by Magnetron Sputtering." Journal of Magnetism and Magnetic Materials. 284. pp. 281-286. (2004).
May 20, 2014 Decision for Granting a Patent issued in Japanese Patent Application No. 2013-092238.
Mar. 11, 2014 Office Action issued in Japanese Patent Application No. 2013-092236.
May 20, 2014 Decision for Granting a Patent issued in Japanese Application No. JP2013-092236.
Apr. 6, 2015 Office Action issued in U.S. Appl. No. 14/261,516.

* cited by examiner

*Primary Examiner* — Weiping Zhu
(74) *Attorney, Agent, or Firm* — Oliff PLC

(57) ABSTRACT

The present invention provides a permanent magnet whose magnetic properties will not be significantly decreased and which is excellent in the temperature properties compared to the existing R-T-B based permanent magnet. In the R-T-B based structure, a stack structure of R1-T-B based crystallizing layer and (Y,Ce)-T-B based crystallizing layer can be formed by alternatively stacking R1-T-B and (Y,Ce)-T-B. In this way, a high magnetic anisotropy field of the R1-T-B based crystallizing layer can be maintained while an improved temperature coefficient of the (Y,Ce)-T-B based crystallizing layer can be obtained. Further, a high coercivity can be obtained by adding the Ce-T-B based crystallizing layer with a low lattice distortion to the Y-T-B based crystallizing layer.

3 Claims, No Drawings

R-T-B BASED PERMANENT MAGNET

FIELD OF THE INVENTION

The present invention relates to a rare earth based permanent magnet, especially a permanent magnet obtained by selectively replacing part of the R in the R-T-B based permanent magnet with Y, Ce.

BACKGROUND

The R-T-B based permanent magnet (R is a rare earth element, and T is Fe or Fe with part of which has been replaced with Co) having a tetragonal compound $R_2T_{14}B$ as the major phase is known to have excellent magnetic properties and has been considered as a representative permanent magnet with high performance since it was invented in 1982 (Patent document 1: JP59-46008A).

In particular, the R-T-B based permanent magnet in which the rare earth element R is formed of Nd, Pr, Dy, Ho and Tb is widely used as a permanent magnet material with a big magnetic anisotropy field Ha. Among them, the Nd—Fe—B based permanent magnet having Nd as the rare earth element R is widely used in people's livelihood, industry, conveyer equipment and the like because it has a good balance among saturation magnetization Is, curie temperature Tc and magnetic anisotropy field Ha and is better in resource volume and corrosion resistance issues than R-T-B based permanent magnets with other rare earth elements. However, the Nd—Fe—B based permanent magnet has a big absolute value of the temperature coefficient of the residual flux density. Especially, it can only have a small magnetic flux under a high temperature above 100V compared to that under room temperature.

PRIOR ART

Patent documents

Patent document 1: JP59-46008A

Patent document 2: JP2011-187624A

Y is known as a rare earth element which has smaller absolute values of the temperature coefficients of residual flux density and coercivity than those of Nd, Pr, Dy, Ho and Tb. In Patent document 2, a Y-T-B based magnet setting the rare earth element R in the R-T-B based permanent as Y has been disclosed, and a permanent magnet with a practical coercivity has been obtained by setting $Y_2Fe_{14}B$ phase whose magnetic anisotropy field Ha is small as the main phase but increasing the amounts of Y and B based on the stoichiometric composition of $Y_2Fe_{14}B$. Further, by setting the rare earth element R in the R-T-B based permanent magnet as Y, a permanent magnet can be obtained with smaller absolute values of the temperature coefficients of residual flux density and coercivity than those of the Nd—Fe—B based permanent magnet. However, the Y-T-B based permanent magnet disclosed in Patent document 2 has a residual flux density of about 0.5 to 0.6 T, a coercivity of about 250 to 350 kA/m and magnetic properties much less than those of the Nd-T-B based permanent magnet. That is, the Y-T-B based permanent magnet described in Patent document 2 is difficult to replace the existing Nd-T-B based permanent magnets.

SUMMARY

Problem to be Solved

Based on the problems mentioned above, the present invention aims to provide a permanent magnet which is excellent in temperature properties and whose magnetic properties will not be significantly deteriorated under a high temperature above 100° C., compared to the R-T-B based permanent magnet which is widely used in people's livelihood, industry, conveyer equipment and etc.

Solution to Solve the Problem

To solve the problems mentioned above and to achieve the goals, a permanent magnet is provided that it has a R-T-B based structure in which a R1-T-B based crystallizing layer (R1 is at least one rare earth element except Y and Ce, and T is at least one transition metal element including Fe or the combination of Fe and Co as necessary) and a (Y,Ce)-T-B based crystallizing layer are stacked. With such a structure, a permanent magnet can be obtained that is excellent in temperature properties and whose magnetic properties will not be significantly deteriorated compared to the existing R-T-B based permanent magnet.

In the present invention, R1, Y and Ce can be used as R. The use of Y can decrease the absolute value for the temperature coefficient but causes a decreased anisotropy field. Therefore, the inventors have found that the high magnetic anisotropy field of the R1-T-B based crystallizing layer can be maintained while the temperature coefficient of the (Y,Ce)-T-B based crystallizing layer can be improved by stacking the R1-T-B based crystallizing layer and the (Y,Ce)-T-B based crystallizing layer. Further, it has been found that a high coercivity can be obtained by adding a Ce-T-B based crystallizing layer with a low lattice distortion to the Y-T-B based crystallizing layer. In this way, the present invention has been completed.

In the R-T-B based permanent magnet of the present invention, the atom ratio of R1 to (Y+Ce) (i.e., R1/(Y+Ce)) is preferably in a range of 0.1 or more and 10 or less. By setting the atom ratio to this range, a balance is achieved between the high magnetic anisotropy field of the R1-T-B based crystallizing layer and the improved effect of the temperature coefficient of the (Y,Ce)-T-B based crystallizing layer. Especially, good magnetic properties can be got.

In the R-T-B based permanent magnet of the present invention, the thickness of the R1-T-B based crystallizing layer is preferably 0.6 nm or more and 300 nm or less and the thickness of the (Y,Ce)-T-B based crystallizing layer is 0.6 nm or more and 200 nm or less. By setting the thickness of these layers to these ranges, part of coercivity inducement mechanism from the single magnetic domain are generated. Especially, a high coercivity can be obtained.

Effect of the Present Invention

The R1-T-B based crystallizing layer and the (Y,Ce)-T-B based crystallizing layer are stacked in the R-T-B based permanent magnet with Y and Ce added so that the obtained permanent magnet keeps a relatively higher coercivity than the R-T-B based permanent magnet having Y and Ce as R. Further, the absolute values for the temperature coefficients of the residual flux density and the coercivity can be lowered compared to the existing R-T-B based permanent magnet having Nd, Pr, Dy, Ho and/or Tb as R.

DETAILED DESCRIPTION OF EMBODIMENTS

The ways for carrying out the present invention (embodiments) are described in detail. However, the present invention is not limited by the following embodiments. In addition, the elements described below may contain elements easily thought of by those skilled in the art and elements which are substantially the same. Furthermore, it is possible to combine the constituent elements described below appropriately.

The R-T-B based permanent magnet of the present embodiment contains 11 to 18 at % of rare earth elements. Here, the R in the present invention includes R1 and Y,Ce as necessary and R1 is at least one rare earth element except Y and Ce. If the amount of R is less than 11 at %, the generation of the $R_2T_{14}B$ phase contained in the R-T-B based permanent magnet is not sufficient, the α-Fe and etc. with soft magnetic properties precipitates and coercivity is significantly decreased. On the other hand, if the amount of R is larger than 18 at %, volume ratio of $R_2T_{14}B$ phase as main phase is decreased, and the residual flux density is reduced. In addition, accompanied that R reacts with O and the amount of the contained O increases, the effective R-rich phase reduces in the formation of coercivity, leading to the decrease of coercivity.

In the present embodiment, the rare earth element R mentioned above contains R1 and Y,Ce. R1 is at least one rare earth element except Y,Ce. As R1, it can contain impurities from the raw materials or other components as impurities mixed in the manufacturing process. Further, if considering to obtain high anisotropy field, R1 is preferably Nd, Pr, Dy, Ho and Tb. In view of the price of the raw materials and the corrosion resistance, Nd is more preferred.

The R-T-B based permanent magnet of the present embodiment contains 5 to 8 at % of B. When B accounts for less than 5 at %, a high coercivity cannot be obtained. In another respect, if B accounts for more than 8 at %, the residual magnetic density tends to decrease. Thus, the upper limit for B is set as 8 at %.

The R-T-B based permanent magnet of the present embodiment may contain Co of 4.0 at % or less. Co forms the same phase as Fe but has effects of an elevated curie temperature and an improved corrosion resistance for the grain boundary phase. In addition, the R-T-B based permanent magnet used in the present invention can contain one or two of Al and Cu in the range of 0.01~1.2 at %. By containing one or two of Al and Cu in such range, the obtained permanent magnet can be realized with high coercivity, high corrosion resistance and the improvement of temperature characteristics.

The R-T-B based permanent magnet of the present embodiment is allowed to contain other elements. For example, elements such as Zr, Ti, Bi, Sn, Ga, Nb, Ta, Si, V, Ag, Ge and etc. can be appropriately contained. On the other hand, impurity elements such as O, N, C and etc. are preferably reduced as much as possible. Especially, the content of O that damages the magnetic properties is preferably 5000 ppm or less, more preferably 3000 ppm or less. The reason is that if the content of oxygen is high, the phase of rare earth oxides as the non-magnetic component increases, leading to lowered magnetic properties.

The R-T-B based permanent magnet of the present embodiment has a R-T-B based structure in which the R1-T-B based crystallizing layer and the (Y,Ce)-T-B based crystallizing layer are stacked. With the stacking of the R1-T-B based crystallizing layer and the (Y,Ce)-T-B based crystallizing layer, a high magnetic anisotropy field of the R1-T-B based crystallizing layer is maintained while the improved effect of the temperature coefficient of the (Y,Ce)-T-B based crystallizing layer can be obtained. In addition, a high coercivity can be obtained by adding Ce-T-B based crystallizing layer with a low lattice distortion to the Y-T-B based crystallizing layer.

Here, the atom ratio of R1 to Y, Ce (i.e., R1/(Y+Ce)) is set preferably to the range of 0.1 or more and 10 or less. By setting the atom ratio to this range, a balance is achieved between the high magnetic anisotropy field of the R1-T-B based crystallizing layer and the improved effect of the temperature coefficient of the (Y,Ce)-T-B based crystallizing layer and especially, high magnetic properties can be got. This atom ratio is not specially restricted if one layer is stacked on the surface to purchase a local improvement.

Further, the thickness of the R1-T-B based crystallizing layer is preferably 0.6 nm or more and 300 nm or less and the thickness of the (Y,Ce)-T-B based crystallizing layer is 0.6 nm or more and 200 nm or less. With respect to each critical particle size in the single magnetic domain, it is about 300 nm for $Nd_2T_{14}B$, about 200 nm for $Y_2Fe_{14}B$ and about 300 nm for $Ce_2Fe_{14}B$. Thus, by stacking the Nd-T-B based crystallizing layer of 300 nm or less and the thinner (Y,Ce)-T-B based crystallizing layer of 200 nm or less, part of coercivity inducement mechanism from the single magnetic domain are generated from the nucleation type for the general coercivity inducement mechanism in the R-T-B based permanent magnet, and a high coercivity can be obtained. In another aspect, the atomic distance in the c-axis direction is about 0.6 nm in the crystal structure of $R_2T_{14}B$. If the atomic distance is smaller than the mentioned atomic distance, the stacking structure of the R1-T-B based crystallizing layer and the (Y,Ce)-T-B based crystallizing layer cannot be formed. If stacking is performed when the thickness is smaller than 0.6 nm, a crystal structure of $R_2T_{14}B$ is obtained in which R1 and Y,Ce are randomly arranged partially.

The ratio of the Y-T-B based crystallizing layer to the Ce-T-B based crystallizing layer, especially the atom ratio of Y to Ce (i.e., Y/Ce), is preferred to be in the range of 0.1 or more and 10 or less. By setting the ratio to such a range, a balance can be obtained between the improved effect of the temperature coefficient of the Y-T-B based crystallizing layer and the high magnetic anisotropy field of the Ce-T-B based crystallizing layer, and especially, good magnetic properties will be obtained.

Hereinafter, the preferred examples for the preparation method of the present invention are described. The preparation methods for the R-T-B based permanent magnet include sintering, rapidly quenched solidification, vapor deposition, HDDR and etc. An example of the preparation method by sputtering in vapor deposition is described below.

As the material, the target is prepared first. The target is set as R1-T-B alloyed target and (Y,Ce)-T-B alloyed target with desired composition. Here, with respect to the composition ratio of the target and the composition ratio of the film made by sputtering, as the sputtering yield for each element is different which causes deviation, adjustment is needed. When a device with three or more sputtering means is used, single-element target with each of R1, Y, Ce, T and B can be prepared so as to perform the sputtering at required ratios. Further, as R1, Y, Ce and T-B, partially alloyed target can be used so as to do the sputtering at required ratios. When other elements such as Zr, Ti, Bi, Sn, Ga, Nb, Ta, Si, V, Ag, Ge and the like are properly contained, two methods involving the alloyed target and the single-element target can be used. In another aspect, the impurity elements such as O, N, C and the like are preferably reduced as much as possible, so the amount of the impurities contained in the targets should be reduced as much as possible.

During the storage, the target is oxidized beginning from the surfaces. The oxidation proceeds quickly when a single-element target with rare earth elements of R1, Y and Ce is used. Therefore, before the use of these targets, sufficient sputtering is necessary so as to expose the clean surfaces of the targets.

For the base material which is film-formed by sputtering, various metals, glass, silicon, ceramics and the like can be selected. In order to get a desired crystal structure, as the treatment at a high temperature is necessary, materials with high melting points are preferred. Furthermore, in addition to the resistance issue in the high-temperature treatment, there are cases where the adhesion to the R-T-B film is not sufficient. Thus, the basement film made of Cr or Ti, Ta, Mo and etc is provided to improve the adhesive property. To prevent the oxidation of the R-T-B film in the upper portion of the R-T-B film, a protection film made of Ti, Ta, Mo and the like can be provided.

With respect to the film-forming device for sputtering, it is preferred that impurity elements such as O, N, C and the like are decreased as much as possible. Thus, gas is preferably exhausted to $10^{-6}$ Pa or less in the vacuum tank, more preferably exhausted to $10^{-8}$ Pa or less. To maintain a high vacuum state, a base material inlet chamber is preferably provided which connects to the film-forming chamber. Then, before the use of the targets, it is necessary to sufficiently perform sputtering so as to expose the clean surfaces of the targets. Thus, the firm-forming device preferably contains a shield machine operated under a vacuum state between the base materials and the targets. For the method for sputtering, in order to decrease the amount of impurity elements as much as possible, it is preferred that the magnetron sputtering is performed under lower Ar atmosphere. Here, the sputtering of the targets containing Fe and Co is hard to be performed as these targets decrease the leakage flux significantly. Thus, it is necessary to choose a target with a proper thickness. The power for sputtering can be any one of DC and RF, depending on the targets.

For the stack structure of the R1-T-B based crystallizing layer and the (Y,Ce)-T-B based crystallizing layer constructed by using the targets and base materials mentioned above, the sputtering of R1-T-B alloyed target and that of the (Y,Ce)-T-B alloyed target are alternatively performed. When the single-element targets with each of R1, Y, Ce, T and B are used, the sputtering of targets with three of R1, T and B is performed at a desired ratio followed by the sputtering of targets with four of Y, Ce, T and B at a required ratio. By repeating the sputtering alternatively, a stack structure which is same as the alloyed targets in use can be obtained. During the sputtering of multiple targets such as R1, T and B as well as Y, Ce, T and B, the sputtering can be done by any one stack sputtering selected from sputtering simultaneously of multiple targets or sputtering individually of each element. The R-T-B based crystal structure can be obtained due to the thermodynamic stability even if the stack sputtering is employed in which stacking is performed with proper ratios and thicknesses and heating is provided. Further, the stack structure can be prepared by transporting the base materials in the film-forming device to perform sputtering of different targets in individual chambers.

For the repeat times of the stack structure, any number can be set when one or more groups of the R1-T-B based crystallizing layer and the (Y,Ce)-T-B are stacked.

The thickness of the R-T-B crystallizing layer refers to that beginning from the end portion with the plane having the R, Fe and B to the end portion. The crystal structure of $R_2T_{14}B$ can be easily recognized because it is constructed by stacking the plane having R, Fe and B and the layer only composed of Fe (referred to as the σ layer) in the c-axis direction.

The thicknesses for the R1-T-B based crystallizing layer and the (Y,Ce)-T-B based crystallizing layer in the stack structure can be set to be any thickness by adjusting the power and time of the sputtering. By applying the difference to the thicknesses of the R1-T-B based crystallizing layer and the (Y,Ce)-T-B based crystallizing layer, the atom ratio of the R1 to Y, Ce(R1/(Y+Ce)) can be adjusted. Further, the thickness can have a slope by changing the thickness upon each repeat. Here, the rate of film formation should be confirmed in advance for the thickness adjustment. The rate of film formation is confirmed by measuring the film formed at a stated power with stated time using a touch-type step gauge. Also, a crystal oscillator film thickness gauge provided in a film-forming device can be used.

In the sputtering, the base material is heated at 400 to 700° C. and crystallized accordingly. In another aspect, the base material can be maintained at RT in the sputtering and subjected to a thermal treatment at 400 to 1100° C. after the film formation which makes it crystallized. In this case, the R-T-B film after the film formation is usually composed of about few tens of nanometers of fine crystals or amorphous substance, and the crystal grows via the thermal treatment. To reduce the oxidation and nitridation as much as possible, the thermal treatment is preferably done under vacuum or inert atmosphere. For the same purpose, it is more preferably to transport the thermal treatment means and the film-forming device under vacuum. The thermal treatment is preferably done in short time and it will be sufficient if the time ranges from 1 minute to 1 hour. Also, the heat in the film formation and the thermal treatment can be optionally done in combination.

Here, the R1-T-B based crystallizing layer and the (Y,Ce)-T-B based crystallizing layer are crystallized based on the energy from sputtering and the energy from the heat to the base material. The energy from sputtering refers to the particles attached to the base material and will disappear once the crystal forms. In another aspect, the energy from the heat to base material is provided continuously during film formation. However, with the thermal energy at 400 to 700° C., the R1-T-B based crystallizing layer and the (Y,Ce)-T-B based crystallizing layer barely disperse so that the stack structure is maintained. When crystallization proceeds in the thermal treatment after film formation at a low temperature, the thermal energy at 400 to 1100V will make the particles of fine crystal grow. However, the R1-T-B based crystallizing layer and the (Y,Ce)-T-B based crystallizing layer barely disperse so that the stack structure is maintained.

A high coercivity can be obtained by adding the Ce-T-B based crystallizing layer with a low lattice distortion to the Y-T-B based crystallizing layer. This is because the R-T-B crystallizing layer contains the crystallization phase of $R_2T_{14}B$. The lattice constant of the a-axis of $Y_2T_{14}B$ crystallization phase is the same as that of the a-axis of $Ce_2T_{14}B$ crystallization phase, so that the lattice distortion becomes smaller. Here, the improved effect of the temperature coefficient of the Y-T-B based crystallizing layer is great but the magnetic anisotropy field is not that high. Thus, by adding the Ce-T-B based crystallizing layer to the Y-T-B based crystallizing layer, the improvement to the temperature coefficient will not be ruined due to the lowered lattice distortion, and high magnetic properties, especially a high coercivity can be obtained. In addition, even as the stack structure of the Y-T-B based crystallizing layer and the Ce-T-B based crystallizing layer, the (Y,Ce)-T-B based crystallizing layer can produce the same effect due to the identical lattice constant of the a-axis.

The stack body produced in the present embodiment can be used as a film magnet as it is or can be further used as a rare earth based bond magnet or a rare earth based sintered magnet. The preparation method will be described below.

An example of the preparation method for the rare earth based bond magnet will be described. First of all, a sputtering made film with a stack structure is peeled from the base material and then be subjected to fine pulverization. Thereafter, in the pressurized mixing mill such as the pressurized kneader, the resin binder containing resins as well as the main powders are milled, and the compound (composition) for rare earth based bond magnet are prepared, wherein the compound contains the resin binder and the powder of R-T-B based permanent magnet having a stack structure. The resin includes the thermosetting resins such as epoxy resin, phenol resin and the like; or thermoplastic resins such as styrene-based, olefin-based, urethane-based, polyester-based, polyamide-based elastomers, ionomers, ethylene-propylene copolymers (EPM), ethylene-ethyl acrylate copolymers and the like. Of these, the resin used in compression molding is preferably thermosetting resins and more preferably the epoxy resin or the phenolic resin. In addition, the resin used in the injection molding is preferably the thermoplastic resins. Further, if required, the coupling agent or other additives can be added in the compound for the rare earth based bond magnet.

For the content ratios of the R-T-B based permanent magnet powders and the resins in the rare earth based bond magnet, it is preferred that 0.5 mass % or more and 20 mass % or less of resins are contained based on 100 mass % of main powders. Based on 100 mass % of R-T-B based permanent magnet powders, if the content of the resin is less than 0.5 mass %, the shape-keeping property tends to lose. If the content of the resin is more than 20 mass %, the excellent enough magnetic properties tend to be difficult to be obtained.

After the preparation of the compound for the rare earth based bond magnet, by subjecting the compound for the rare earth based bond magnet to the injection molding, a rare earth based bond magnet can be obtained which contains the R-T-B based permanent magnet powders (which have a stack structure) and resins. If the rare earth based bond magnet is prepared by injection molding, the compound for the rare earth based bond magnet is heated to the fusion temperature of the binder (the thermoplastic resin) if needed. Then, the compound for the rare earth based bond magnet in a flow state is subjected to the injection molding in a mold having a specified shape. After cooled down, the molded product (i.e., the rare earth based bond magnet) with a specified shape is taken out from the mold. In this way, a rare earth based bond magnet is yielded. The preparation method for the rare earth based bond magnet is not limited to the injection molding mentioned above. For example, the compound for the rare earth based bond magnet can also be subjected to the compression molding so as to get a rare earth based bond magnet containing the R-T-B based permanent magnet powders and resins. When the rare earth based bond magnet is produced via compression molding, after the compound for the rare earth based bond magnet is prepared, the compound for the rare earth based bond magnet is filled in a mold with a stated shape. After the application of pressures, the molded product (i.e., the rare earth based bond magnet) with a stated shape is taken out from the mold. If the compound for the rare earth based bond magnet is molded using a mold and is then taken out, such a process can also be done by the compression molding machine such as a mechanical press or oil-pressure press and the like. Thereafter, the formed body is placed in a furnace such as a heating furnace or a vacuum drying oven and cured by heat so that a rare earth based bond magnet is obtained.

The shape of the molded rare earth based bond magnet is not particularly limited, and corresponding to the shape of the mold in use, it can be changed according to the shape of the rare earth based bond magnet, such as tabular, columnar and a shape with the section being circular. Further, to prevent the oxidation layer or the resin layer from deteriorating, the surfaces of the obtained rare earth based bond magnet can be subjected to plating or the surfaces can be coated with paint.

When the compound for the rare earth based bond magnet is molded as the intended specified shape, magnetic field is applied and the molded body derived from molding is oriented in a specific direction. Thus, an anisotropic rare earth based bond magnet with stronger magnetic performances is obtained as the rare earth based bond magnet is oriented in a specific direction.

An example of the preparation method for the rare earth based sintered magnet is described below. As mentioned above, the powders of the R-T-B based permanent magnet having a stack structure are formed to have an intended shape by the compression molding or the like. The shape of formed body obtained by molding the powders of the R-T-B based permanent magnet with a stack structure is not particularly limited, and corresponding to the shape of the mold in use, it can be changed according to the shape of the rare earth based sintered magnet, such as tabular, columnar and a shape with the section being circular.

Then, a thermal treatment is applied to the molded body for 1 to 10 hours under vacuum or inert atmosphere at a temperature of 1000° C. to 1200° C. so as to perform the firing. Accordingly, a sintered magnet (a rare earth based sintered magnet) can be obtained. After the firing, the obtained rare earth based sintered magnet is kept at a temperature lower than that upon firing so that an aging treatment is applied to these rare earth based sintered magnet. The aging treatment is a two-stage heating process in which heating is applied for 1 to 3 hours at 700° C. to 900° C. and then heating is applied for 1 to 3 hours at 500° C. to 700° C.; or a one-stage heating process in which heating is performed for 1 to 3 hours at about 600° C. The treatment condition can be appropriately adjusted depending on the times of aging treatment. Such an aging treatment can improve the magnetic properties of the rare earth based sintered magnet.

The obtained rare earth based sintered magnet can be cut into desired sizes and the surfaces can be smoothed so that the resultant can be used as a rare earth based sintered magnet with a specified shape. Also, the surfaces of the obtained rare earth based sintered magnet can be subjected to plating or the surfaces can be coated with paint so as to prevent the oxidation layer or the resin layer from deteriorating.

Furthermore, when the powders of the R-T-B based permanent magnet having a stack structure is molded to have an intended specified shape, magnetic field is applied and the molded body from molding is oriented in a specific direction. Thus, an anisotropic rare earth based sintered magnet with stronger magnetic performances is obtained as the rare earth based sintered magnet is oriented in a specific direction.

Examples

Hereinafter, the present invention will be specifically described by Examples and Comparative Examples. However, the present invention is not limited to the following Examples.

The targets were produced as the Nd—Fe—B alloyed target, Pr—Fe—B alloyed target, (Y,Ce)—Fe—B alloyed target, Y—Fe—B alloyed target and Ce—Fe—B alloyed target which were adjusted to the sputtering-formed films being the composition of $Nd_{15}Fe_{78}B_7$, $Pr_{15}Fe_{78}B_7$, $(Y_aCe_b)_{15}Fe_{78}B_7$, $Y_{15}Fe_{78}B_7$ and $Ce_{15}Fe_{78}B_7$. In addition, (Y,Ce)—Fe—B alloyed targets were produced as a plurality of targets whose ratio of Y and Ce was changed. The Silicon substrate was prepared on the base material used for film formation. The conditions were as follows. The size of targets had a diameter of 76.2 mm, the size of the base material was 10 mmx 10 mm, and the plane uniformity of the film was kept sufficient.

A device which discharges the gases at $10^{-8}$ Pa or less and had a plurality of sputtering means in the same tank was used as the film-forming device. Then, in the film-forming device, the Nd—Fe—B alloyed target, Pr—Fe—B alloyed target, (Y,Ce)—Fe—B alloyed target, Y—Fe—B alloyed target, Ce—Fe—B alloyed target and Mo target (which was used for the basement film and the protection film) were provided according to the composition of the test materials to be prepared. Sputtering was performed by the magnetron sputtering which used Ar atmosphere of 1 Pa and the RF generator. The power of the RF generator and the time for film formation were adjusted according to the composition of the test materials.

In the composition of the film, Mo formed a film of 50 nm as the basement film. Then, the thicknesses of the R1-Fe—B layer and the (Y,Ce)—Fe—B layer were adjusted according to each Example and Comparative Example and the sputtering was performed accordingly. The sputtering proceeded through two methods based on the composition of the test materials. In one method the sputtering of two targets was performed alternatively and in another method the sputtering of two targets was performed simultaneously. After the film formation of the R—Fe—B film, Mo formed a film of 50 nm as the protection film.

During the film formation, the silicon substrate of the base material was heated to 600° C. so as to crystallize the R—Fe—B film. After the film formation of the magnetic layer, a protection film was formed at 200° C. and was taken out of the firm-forming device after it was cooled to RT under vacuum. The test materials were shown in Table 1.

TABLE 1

| | Species of R1 | Species of Y, Ce | Ratio of R1 to (Y + Ce) R1: (Y + Ce) | Thickness of R1—Fe—B Layer (nm) | Thickness of (Y,Ce)—Fe—B layer (nm) | Repeat count (times) | Film thickness of magnetic layer (nm) | Method for sputtering |
|---|---|---|---|---|---|---|---|---|
| Example 1 | Nd | Y50.0Ce50.0 | 100.0:10.0 | 200.0 | 20.0 | 10 | 2200.0 | Sputtering of two targets performed alternatively |
| Example 2 | Nd | Y50.0Ce50.0 | 10.0:100.0 | 20.0 | 200.0 | 10 | 2200.0 | Sputtering of two targets performed alternatively |
| Example 3 | Nd | Y50.0Ce50.0 | 50.0:50.0 | 100.0 | 100.0 | 10 | 2000.0 | Sputtering of two targets performed alternatively |
| Example 4 | Nd | Y50.0Ce50.0 | 92.0:8.0 | 184.0 | 16.0 | 10 | 2000.0 | Sputtering of two targets performed alternatively |
| Example 5 | Nd | Y50.0Ce50.0 | 8.0:92.0 | 16.0 | 184.0 | 10 | 2000.0 | Sputtering of two targets performed alternatively |
| Example 6 | Nd | Y50.0Ce50.0 | 50.0:50.0 | 400.0 | 400.0 | 10 | 8000.0 | Sputtering of two targets performed alternatively |
| Example 7 | Pr | Y50.0Ce50.0 | 100.0:10.0 | 200.0 | 20.0 | 10 | 2200.0 | Sputtering of two targets performed alternatively |
| Example 8 | Nd | Y50.0Ce50.0 | 83.0:17.0 | 166.0 | 34.0 | 10 | 2000.0 | Sputtering of two targets performed alternatively |
| Example 9 | Nd | Y50.0Ce50.0 | 50.0:50.0 | 300.0 | 300.0 | 10 | 6000.0 | Sputtering of two targets performed alternatively |
| Example 10 | Nd | Y50.0Ce50.0 | 50.0:50.0 | 0.6 | 0.6 | 1500 | 1800.0 | Sputtering of two targets performed alternatively |
| Example 11 | Nd | Y50.0Ce50.0 | 50.0:50.0 | 0.4 | 0.4 | 2250 | 1800.0 | Sputtering of two targets performed alternatively |
| Example 12 | Nd | Y50.0Ce50.0 | 66.7:33.3 | 0.8 | 0.4 | 1500 | 1800.0 | Sputtering of two targets performed alternatively |
| Example 13 | Nd | Y50.0Ce50.0 | 99.2:0.8 | 100.0 | 0.8 | 20 | 2016.0 | Sputtering of two targets performed alternatively |
| Example 14 | Nd | Y50.0Ce50.0 | 50.0:50.0 | 100.0 | 100.0 | 5 | 1000.0 | Sputtering of two targets performed alternatively |
| Example 15 | Nd | Y17.0Ce83.0 | 50.0:50.0 | 100.0 | 100.0 | 10 | 2000.0 | Sputtering of two targets performed alternatively |
| Example 16 | Nd | Y100.0Ce10.0 | 50.0:50.0 | 100.0 | 100.0 | 10 | 2000.0 | Sputtering of two targets performed alternatively |
| Example 17 | Nd | Y83.0Ce17.0 | 50.0:50.0 | 100.0 | 100.0 | 10 | 2000.0 | Sputtering of two targets performed alternatively |
| Example 18 | Nd | Y8.3Ce91.7 | 50.0:50.0 | 100.0 | 100.0 | 10 | 2000.0 | Sputtering of two targets performed |

TABLE 1-continued

| | Species of R1 | Species of Y, Ce | Ratio of R1 to (Y + Ce) R1: (Y + Ce) | Thickness of R1—Fe—B Layer (nm) | Thickness of (Y,Ce)—Fe—B layer (nm) | Repeat count (times) | Film thickness of magnetic layer (nm) | Method for sputtering |
|---|---|---|---|---|---|---|---|---|
| | | | | | | | | alternatively |
| Example 19 | Nd | Y92.3Ce7.7 | 50.0:50.0 | 100.0 | 100.0 | 10 | 2000.0 | Sputtering of two targets performed alternatively |
| Comparative Example 1 | Nd | Y50.0Ce50.0 | 100.0:10.0 | 2000.0 | 200.0 | — | 2200.0 | Sputtering of two targets performed simultaneously |
| Comparative Example 2 | Nd | Y50.0Ce50.0 | 10.0:100.0 | 200.0 | 2000.0 | — | 2200.0 | Sputtering of two targets performed simultaneously |
| Comparative Example 3 | Nd | Y | 100.0:10.0 | 200.0 | 20.0 | 10 | 2200.0 | Sputtering of two targets performed alternatively |
| Comparative Example 4 | Nd | Ce | 100.0:10.0 | 200.0 | 20.0 | 10 | 2200.0 | Sputtering of two targets performed alternatively |

After the evaluation of the magnetic properties, the prepared test materials were subjected to the inductively coupled plasma atomic emission spectroscopy (ICP-AES) in which the atom ratio was confirmed to be as designed.

In addition, to investigate if the prepared test materials had stack structure of R1-Fe—B based crystallizing layer and (Y,Ce)—Fe—B based crystallizing layer, an observation to the sections and a composition analysis to the sections were performed after the evaluation of the magnetic properties. During the analysis, the test materials were processed using a device used for focused ion beam and then observed by a scanning transmission electron microscopy (STEM). Furthermore, the elements were analyzed via X-ray energy dispersive spectroscopy (EDS). As a result, it was confirmed that the diffusion of the rare earth elements didn't occur and there had a stack structure as designed.

The magnetic properties of each test material were measured using a vibrating sample magnetometer (VSM) by applying a ±4T magnetic field to the film's plane in a vertical direction. Table 2 shows the coercivity at 120° C. and the temperature coefficient of the test materials listed in Table 1.

TABLE 2

| | Temperature for test (° C.) | HcJ (kA/m) | HcJ (%/° C.) |
|---|---|---|---|
| Example 1 | 120 | 443 | −0.415 |
| Example 2 | 120 | 410 | −0.412 |
| Example 3 | 120 | 431 | −0.412 |
| Example 4 | 120 | 214 | −0.440 |
| Example 5 | 120 | 205 | −0.439 |
| Example 6 | 120 | 249 | −0.432 |
| Example 7 | 120 | 445 | −0.417 |
| Example 8 | 120 | 434 | −0.413 |
| Example 9 | 120 | 259 | −0.429 |
| Example 10 | 120 | 425 | −0.413 |
| Example 11 | 120 | 237 | −0.433 |
| Example 12 | 120 | 254 | −0.430 |
| Example 13 | 120 | 206 | −0.441 |
| Example 14 | 120 | 431 | −0.412 |
| Example 15 | 120 | 430 | −0.409 |
| Example 16 | 120 | 423 | −0.415 |
| Example 17 | 120 | 432 | −0.413 |
| Example 18 | 120 | 396 | −0.419 |
| Example 19 | 120 | 390 | −0.421 |
| Comparative Example 1 | 120 | 118 | −0.459 |
| Comparative Example 2 | 120 | 116 | −0.460 |

TABLE 2-continued

| | Temperature for test (° C.) | HcJ (kA/m) | HcJ (%/° C.) |
|---|---|---|---|
| Comparative Example 3 | 120 | 190 | −0.451 |
| Comparative Example 4 | 120 | 185 | −0.451 |

If the Examples and Comparative Examples 1 and 2 were compared, it can be seen that the test materials having R1-Fe—B based crystallizing layer and (Y,Ce)—Fe—B based crystallizing layer stacked had a high coercivity and a small absolute value of the temperature coefficient. This was because the stacking of R1-Fe—B based crystallizing layer and the (Y,Ce)—Fe—B based crystallizing layer could maintain the high magnetic anisotropy field of the R1-Fe—B based crystallizing layer and at the same time obtain the improved effect of the temperature coefficient of the (Y,Ce)—Fe—B based crystallizing layer.

If the magnetic properties between the Examples and Comparative Examples 3 and 4 were compared, the test materials from Examples were known to have a high coercivity and a small absolute value of the temperature coefficient. This was due to the addition of Ce-T-B based crystallizing layer with a low lattice distortion to the Y-T-B based crystallizing layer, which leaded to obtain a high coercivity.

If the Examples were compared, it can be known that by rendering the atom ratio of R1 to (Y+Ce) (i.e., R1/(Y+Ce)) within the range of 0.1 or more and 10 or less, a balance was achieved between the high magnetic anisotropy field of the R1-Fe—B based crystallizing layer and the improved effect of the temperature coefficient of the (Y,Ce)—Fe—B based crystallizing layer. Especially, high magnetic properties can be obtained.

If the Examples were compared, it can be known that coercivity inducement mechanism from the single magnetic domain were generated partially by setting the thickness of the R1-Fe—B based crystallizing layer being 0.6 nm or more and 300 nm or less and the thickness of the (Y,Ce)—Fe—B based crystallizing layer being 0.6 nm or more and 200 nm or less. Especially, high magnetic properties can be obtained.

If Example 1 and Example 7 was compared, then it can be seen that the test material also had high magnetic properties and a small absolute value of the temperature coefficient even if R1 was changed from Nd to Pr.

What is claimed is:

1. A R-T-B based permanent magnet, comprising:

a R-T-B based structure in which a R1-T-B based crystallizing layer and a (Y,Ce)-T-B based crystallizing layer are stacked, wherein:

R1 is at least one rare earth element except Y and Ce, and

T is at least one transition metal element including Fe or a combination of Fe and Co.

2. The R-T-B based permanent magnet according to claim 1, wherein an atomic ratio of R1 to (Y+Ce) is 0.1 or more and 10 or less.

3. The R-T-B based permanent magnet according to claim 1, wherein the R1-T-B based crystallizing layer has a thickness of 0.6 nm or more and 300 nm or less, and the (Y,Ce)-T-B based crystallizing layer has a thickness of 0.6 nm or more and 200 nm or less.

* * * * *